United States Patent [19]

Penna et al.

[11] 4,417,716

[45] Nov. 29, 1983

[54] NOVELTY ICE TRAY

[76] Inventors: Americo Penna, c/o George Spector, 3615 Woolworth Bldg., 233 Broadway; George Spector, c/o Americo Penna, 3615 Woolworth Bldg., 233 Broadway, both of New York, N.Y. 10007

[21] Appl. No.: 343,098

[22] Filed: Jan. 27, 1982

[51] Int. Cl.[3] ..... B29C 1/02

[52] U.S. Cl. ..... 249/121; 249/127; 249/129; 249/165

[58] Field of Search ..... 249/119, 121, 127, 129, 249/163, 165

[56] References Cited

U.S. PATENT DOCUMENTS

| | | | |
|---|---|---|---|
| 951,688 | 3/1910 | Lee | 249/165 X |
| 964,112 | 7/1910 | Kruse | 249/165 X |
| 2,083,081 | 6/1937 | Mall | 249/127 X |
| 2,106,009 | 1/1938 | Lee | 249/119 X |
| 2,273,109 | 2/1942 | Hightower | 249/165 X |
| 2,291,672 | 8/1942 | Youngberg | 249/119 |
| 3,727,875 | 4/1973 | Downing | 249/121 |

*Primary Examiner*—Thomas P. Pavelko

[57] ABSTRACT

An ice tray including an upper and lower section locked together so to form completely enclosed chambers therebetween in which enclosed water freezes into a fully desired shape of ice cube.

2 Claims, 11 Drawing Figures

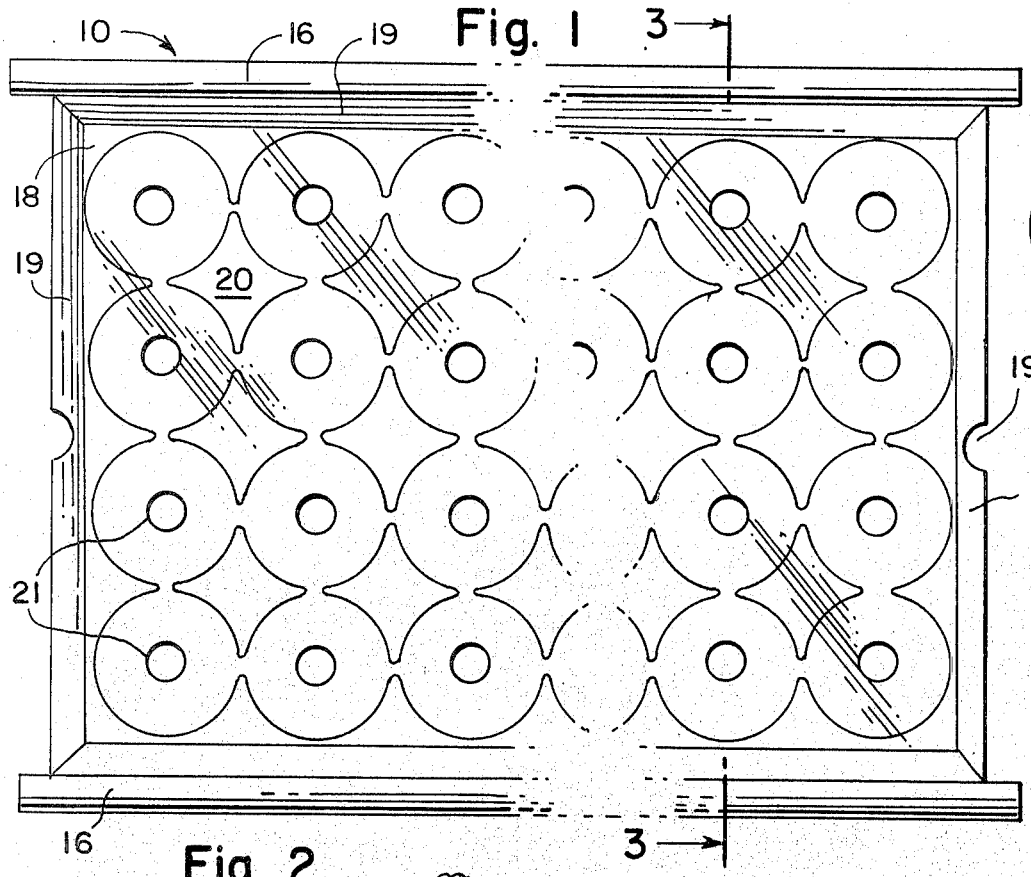
Fig. 1
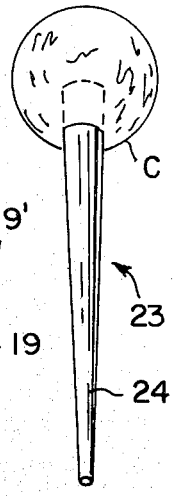
Fig. 4
Fig. 2
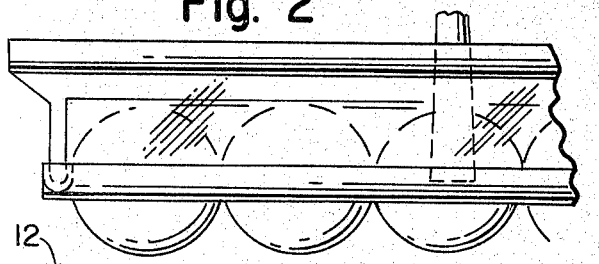
Fig. 3
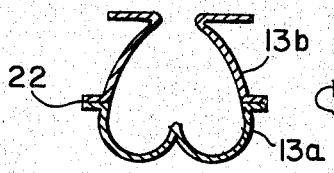
Fig. 5
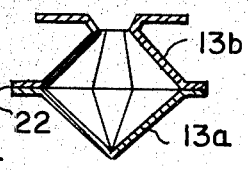
Fig. 6
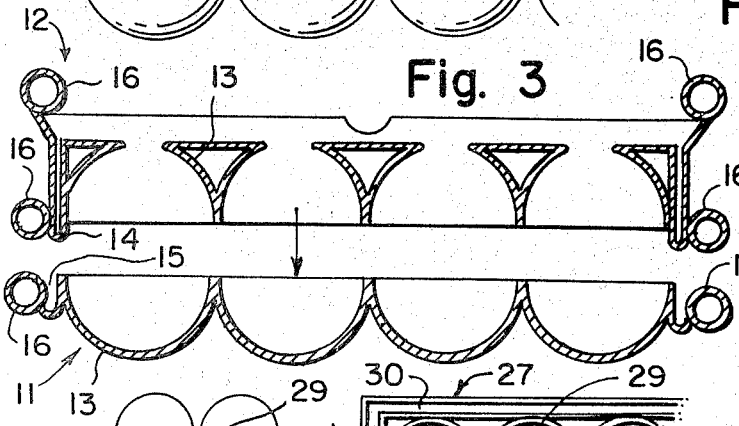
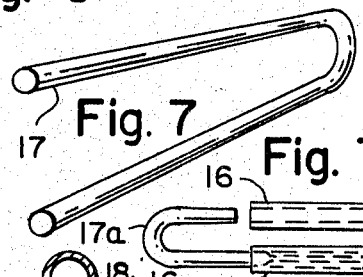
Fig. 7
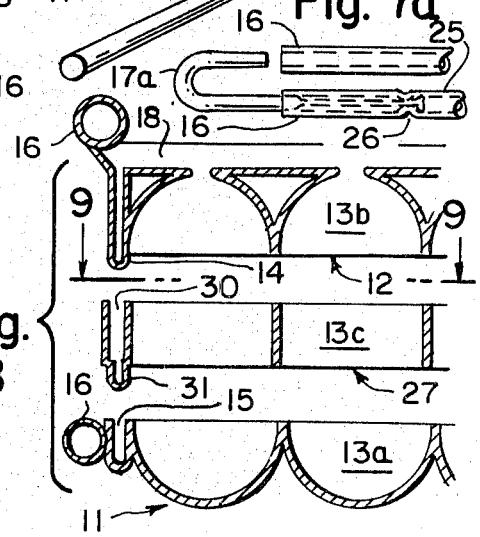
Fig. 7a
Fig. 8
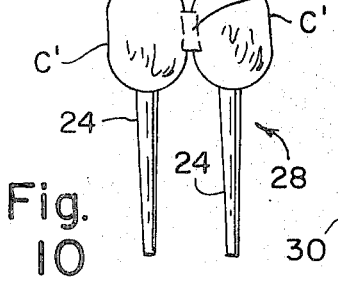
Fig. 10
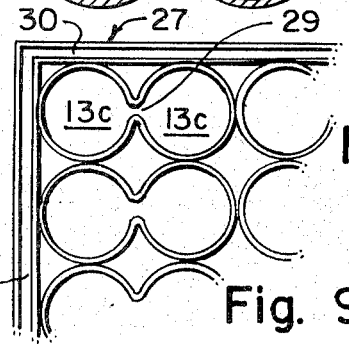
Fig. 9

NOVELTY ICE TRAY

This invention relates gneerally to ice trays, such as are placed, containing water, winto a freezer compartment of a home refrigerator in order to make ice cubes for use when serving cool beverages.

It is well known that all such ice cubes have been made heretofore in cubic shapes, and accordingly are uninteresting and commonplace.

It is believed that in this age of changes and improvements in practically everything that the ordinary ice cube should likewise be changes in order to acquire some appeal instead of remaining dull.

Therefore it is a principal object of the present invention to provide an ice tray for molding ice cubes of various different shapes in order to have eye appeal.

Another object is to provide a novelty ice tray which accordingly can mold a plurality of different shaped cubes in a single tray, so as to form cubes in a single tray, so as to form sets of different designs, such as for example, hearts, clubs, diamonds and spade, which would make interesting conversation pieces when served in drinks at a card party, and which also would aid for persons to identify their own glass from amongst others.

Yet a further object is to provide a novelty ice tray which molds all the surfaces of an ice cube instead of leaving a top surface of the cube unmolded, such as reslts by the use of a conventional, old fashioned, ice tray.

FIG. 1 is a top plain view of the invention shown fragmentary.

FIG. 2 is a fragmentary side elevation view thereof.

FIG. 3 is a cross sectional view on line 3—3 of FIG. 1.

FIG. 4 is a perspective view of a popsicle on a stick and which was made in the tray invention, as shown in FIG. 2.

FIG. 5 and FIG. 6 are details of trays that mold ice cubes of different designs.

FIG. 7 is a perspective view of a clip for locking the tray and cover together.

FIG. *7a* shows a modified design thereof.

FIG. 8 is a view similar to FIG. 3, and showing a different design that includes an intermediate section for producing double popsicles as shown in FIG. 10.

FIG. 9 is a view in direction 9—9 of FIG. 8 and showing a part of the intermediate section.

FIG. 10 isza side view of a double popsicle made in the tray assembly shown in FIG. 8.

Referring now to the drawing, in greater detail, and more particularly to FIGS. 1 through 7 thereof, the reference numeral 10 represents a novelty ice tray according to the present invention, wherein the same is comprises of a lower sectional 11 and an upper section 12, that fit together, and which are preferably molded from a clear plastic in order to be inexpensive to make and are smooth surfaced so that they are easy to keep cleans and sanitary.

Alternately however they may be of tinted plastic aso as to match the refrigerator decor, and alternately they may be made from an aluminum alloy or hard rubber.

FIGS. 1, 2 and 3 show the tray designed for molding spherical shaped ice cubes. Each section 11 and 12 may be made with eleven rows of hemispherical forms 13, each row having four forms, as shown, so that the tray is of a conventional size to fit in a typical freezer. The forms of the two sections align with each other. The upper section includes a downward lip 14 around all four of its sides, and which snap fits inside a corresponding groove 15 formed around all sides of the lower section so that the two sections fit together in a water tight manner. A long tube 16 formed along each longitudinal side of each section serves to receive one end of a lock pin 17 at each opposite end thereof, the pins thus locking the sections together so that when the tray is filled with water, it will not leak, when carried to the freezer and placed therein.

The upper section includes a shallow pan 18 formed upon its top by means of angularly outwardly upwardly sidewalls 19 forms around all edges of its top wall 20, so that running water may be poured into the pan when filling the ice tray. Small holes 21 in the top wall allow the water to run down inside the forms 13 of the locked together sections. The pan prevents any surface water from dripping off when placed in the freezer. A notch 19' along an upper edge of the side walls 19 lowers the pan water level.

As shown in FIGS. 5 and 6, the forms 13*a* and 13*b* of the lower, and upper sections are shaped in any other design such as the heart and diamond here illustrated. The parting line 22, between the sections, is located at the widest point of the design, so that after the water within the two sections freezes into a singular cube, the cube may then be easily removed when the sections are separated. To remove the dcubes, a little hot water is run around the two sections so as to loosen the cubes in a usual manner.

If the tray is used to make frozen popsicles 23 for children, a plastic or wooden stick 24 of slightly conical shape, is fitted in each hole 21 so as to extend into the water, so that after the freezing operation, the stick serves as a handle to hold the cube C while being licked.f For such popsickles, the water is flavored with various syrups, or cream may be used to make a creamsickle.

FIG. *7a* shows a design of lock pin 17*a* having an enlarged head 25 at one end for abutting a constructing stop 26 inside the tube 16 in order to prevent complete disengagement from one of the sections and misplacement of the lock pin while the sections are separated.

FIGS. 8 and 9 show another design of novelty ice tray which in addition to the above described components, also includes an intermediate section 27 which may be used therewith so to form a double popsicle 28 as shown in FIG. 10, and wherein a frozen web 29 is formed between two frozen cubes C. In this design some of the forms 13*c* includes a passage 29 therebetween so that the water therein freezes to form the web. The intermediate section includes a groove 30 to receive the lip of section 12 and it includes a lip 31 for fitting inside the groove of section 11.

While various changes may be made in the detail construction, it is understood that such changes will be within the spirit and scope of the present invention as is defined by the appended claims.

What is claimed:

1. A novelty ice tray, comprising in combination, an upper and lower section, a plurality of hollow forms in each said section, lock means to secure said sections water tight together, and said forms of said sections aligning with each other, said forms being of various shape so that water frozen therein becomes a shaped ice cube, and means for a plurality of said ice cubes being frozen together, wherein said lock means comprises a U-shaped lock pin inserted tubes formed on said sections wherein an overflow pan is formed upon a top of said upper section.

2. An ice tray as in claim 1 in combination with a middle section adapted to align with the upper and lower sections including means to mount the upper section on said middle section and said lower section.

* * * * *